US006315176B1

(12) United States Patent
Abdi

(10) Patent No.: US 6,315,176 B1
(45) Date of Patent: Nov. 13, 2001

(54) GARMENT HANGER

(75) Inventor: Abraham Abdi, Orange, CA (US)

(73) Assignee: Merrick Engineering, Inc, Corona, CA (US)

( * ) Notice: Subject to any disclaimer, the term of this patent is extended or adjusted under 35 U.S.C. 154(b) by 0 days.

(21) Appl. No.: 09/617,730

(22) Filed: Jul. 17, 2000

(51) Int. Cl.[7] ..... A47G 25/14
(52) U.S. Cl. ..... 223/85; 223/DIG. 4
(58) Field of Search ..... 223/85, 92, 88, 223/95, DIG. 4

(56) References Cited

U.S. PATENT DOCUMENTS

D. 206,303 * 11/1966 Louik ..... 223/85
2,164,420 * 7/1939 Petty ..... 223/85
5,649,653 * 7/1997 Joseph ..... 223/85
5,806,727 * 9/1998 Joseph ..... 223/85
6,047,867 * 4/2000 Heiber ..... 223/96

* cited by examiner

*Primary Examiner*—Bibhu Mohanty
(74) *Attorney, Agent, or Firm*—G. Donald Weber, Jr.

(57) ABSTRACT

This invention is directed to garment hangers which are particularly adapted for use with clothes having small neck openings and wherein the hook includes a generally inwardly concave neck adjacent the midsection of the hanger.

7 Claims, 5 Drawing Sheets

GARMENT HANGER

BACKGROUND OF THE INVENTION

1. Field of the Invention

This invention relates to garment hangers, in general, and, more particularly, to hangers for garments having relatively small collar or neck openings.

2. Prior Art

Many garment hangers are known in the art. The known hangers have many shapes and configurations related to specific uses of the hangers. One such use is a hanger for use with a garment having a relatively small neck opening.

The most pertinent prior art known discloses a hanger structure wherein the hanger support structure (hook) and the hanger arms are specifically interrelated with a convex, angulated leg extension of the hanger support structure in order to effectively lengthen the perimeter distance along one hanger arm while still achieving a common interconnection location between upper ends of the two shoulder supports of the hanger and the lower end of the angular leg extension of the hook.

U.S. Pat. No. 2,164,420 to Petty discloses a wire clothes hanger for a garment having "a comparatively small neck." However, the Petty hanger requires an integrally associated garment retaining means to hold the garment on the hanger.

U.S. Pat. No. 3,485,423 to Wagar et al discloses a wire hanger potentially usable for clothes having small neck openings. The lower end of one hanger shoulder support is joined by a continuous wire to the upper end of the other shoulder support. However the Wagar et. al. '423 hanger has geometric restrictions and is relatively inconvenient and cumbersome to use.

U.S. Pat. No. 5,806,727 to Joseph discloses a plastic hanger for garments having a small neck opening but requires a J-slot configuration of the hanger.

U.S. Pat. No. 5,649,653 to Joseph discloses a plastic hanger for garments having a small neck opening but requires an "angled knee" in the hook portion of the hanger.

There is a need for new and improved clothes hangers which are adapted for use with small-necked garments and which overcome and avoid such prior art problems. The present invention satisfies this need.

SUMMARY OF THE INVENTION

This invention is directed to an improved garment hanger particularly adapted for use with clothes having small neck openings. Several embodiments of the hanger are shown.

Each embodiment of the hanger includes two opposed support arms for supporting a garment. The support arms are joined together at a median point. In addition to an upper support surface (or leg), the support arms may also include a lower connecting leg or surface. The hanger also includes a hanger hook having an elongated connecting leg which extends between the hook, per se, and an interconnection location which is offset from the median (or Joinder) point of the upper ends of the support surface of the two opposed support arms of the hanger. The connecting leg of the hook is generally coplanar with the support arms.

Because the two hanger support arms have respective upper ends joined together at a median point and the lower end of the connecting leg of the hook is off-center relative to the hanger, one support arm of the hanger has, effectively, a greater unobstructed perimeter distance than the other support arm of the hanger. This greater effective perimeter distance of one arm permits the longer arm to be inserted through a garment neck whereby the garment can be advanced along the longer arm to a location where the shorter arm can be slipped through the neck and into the garment. (The procedure is reversed for removing a garment from the hanger.) This configuration of the hanger avoids and prevents damage to the garment neck region.

The preferred embodiments of the hanger are simple, rugged and economical to fabricate and manufacture and can be made with various materials and various production processes.

The objects and advantages of the several embodiments will be apparent to those skilled in the art from the present specification taken with the accompanying drawings and the appended claims.

DETAILED DESCRIPTION

Figures 1, 2:
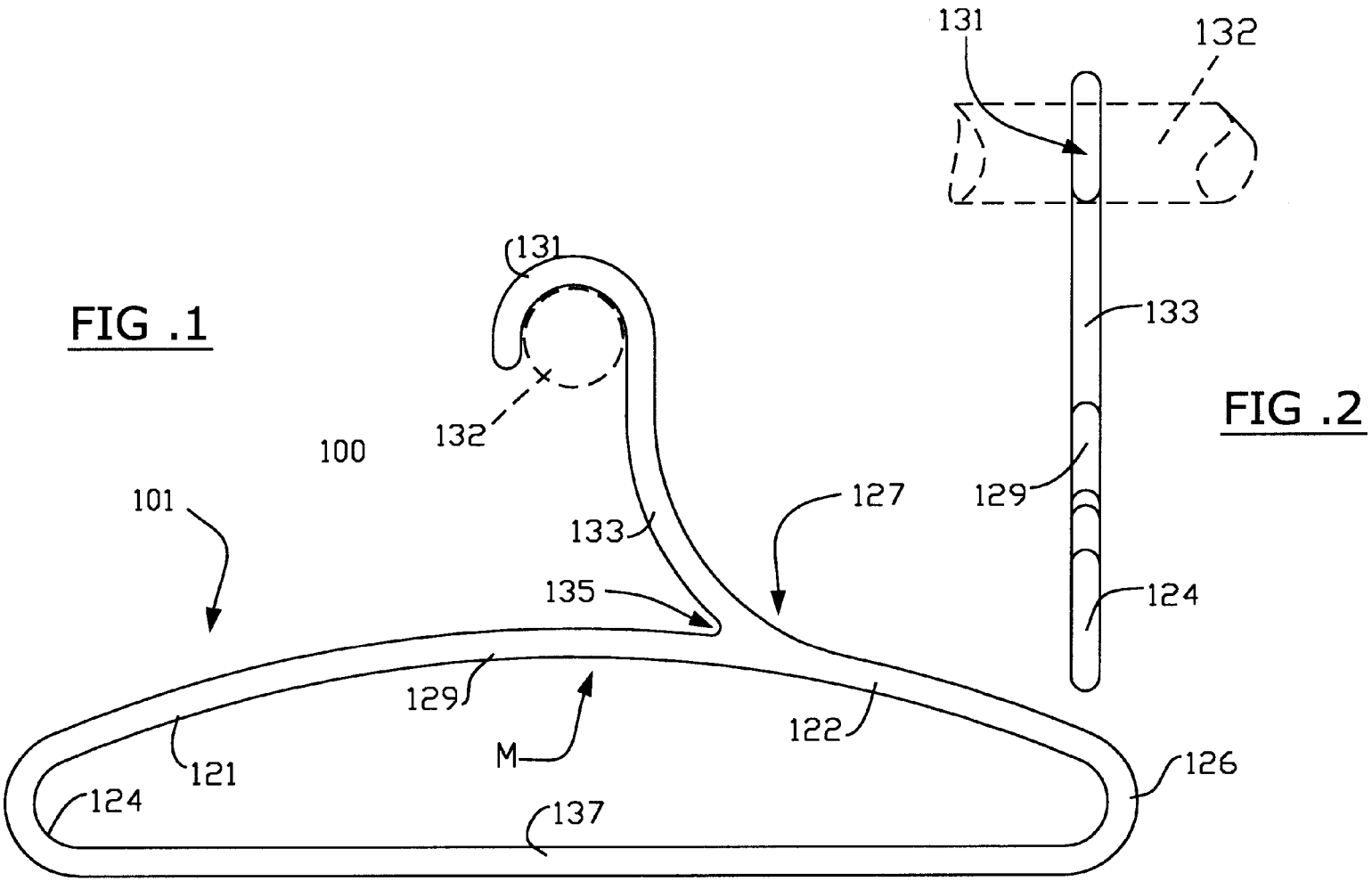
FIG. 1 is a side elevational view of one embodiment of a garment hanger of the instant invention showing a conventional closet support rod in dotted outline.
FIG. 2 is an end elevational view of the hanger of FIG. 1 taken from the left end of FIG. 1.

Referring to FIG. 1, there is shown a side elevation view of garment hanger which represents one embodiment of the instant invention. Hanger 100 includes a support rod 101 which incorporates two elongated arms 121 and 122, each of which is adapted for supporting a different shoulder of a garment. Preferably, arms 121 and 122 are about equal to each other in length in hanger 100. The inner ends of arms 121 and 122 join together and form a continuous mid-region 129. In the preferred embodiment, each arm 121 and 122 extends generally and downwardly relative to the other arm and relative to the mid-region 129. Arms 121 and 122 have an outer end 124 and 126, respectively, which, in a preferred embodiment is rounded for convenience in mounting a garment onto the hanger.

Optionally, but preferably, the outer ends 124 and 126 of hanger 100 are interconnected by an elongated lower cross member 137. Such interconnections are, preferably, integrally formed and curved in order to avoid catching or snagging any contacting portion of a garment.

The hanger 100 incorporates a hook 131, for supporting the hanger from a closet rod 132 or the like (shown in dashed outline in FIG. 1). When so hung, the relationship between the hook 131 and the arms 121 and 122 is such that the arms 121 and 122 are in a generally symmetrical, balanced relationship relative to one another and to the mid-region 129. The hook has smoothly convex arcuate connecting leg 133 which terminates at, and joins to, the arm 122 at a joinder location 127 which is slightly offset from the center M of the mid region 129 and the middle of the overall hanger length. As a result, an unobstructed perimeter distance extends from the outer end 124 along arm 121 to a location that is substantially past the midpoint M of the hanger length. Thus, when the arm 121 is inserted into the neck region of a garment, the arm 121 is advanceable through the neck region, past the midpoint M until the neck of the garment is adjacent to the lower portion of hook leg 133. A support fillet 135 may be provided, if desired.

Figure 3:
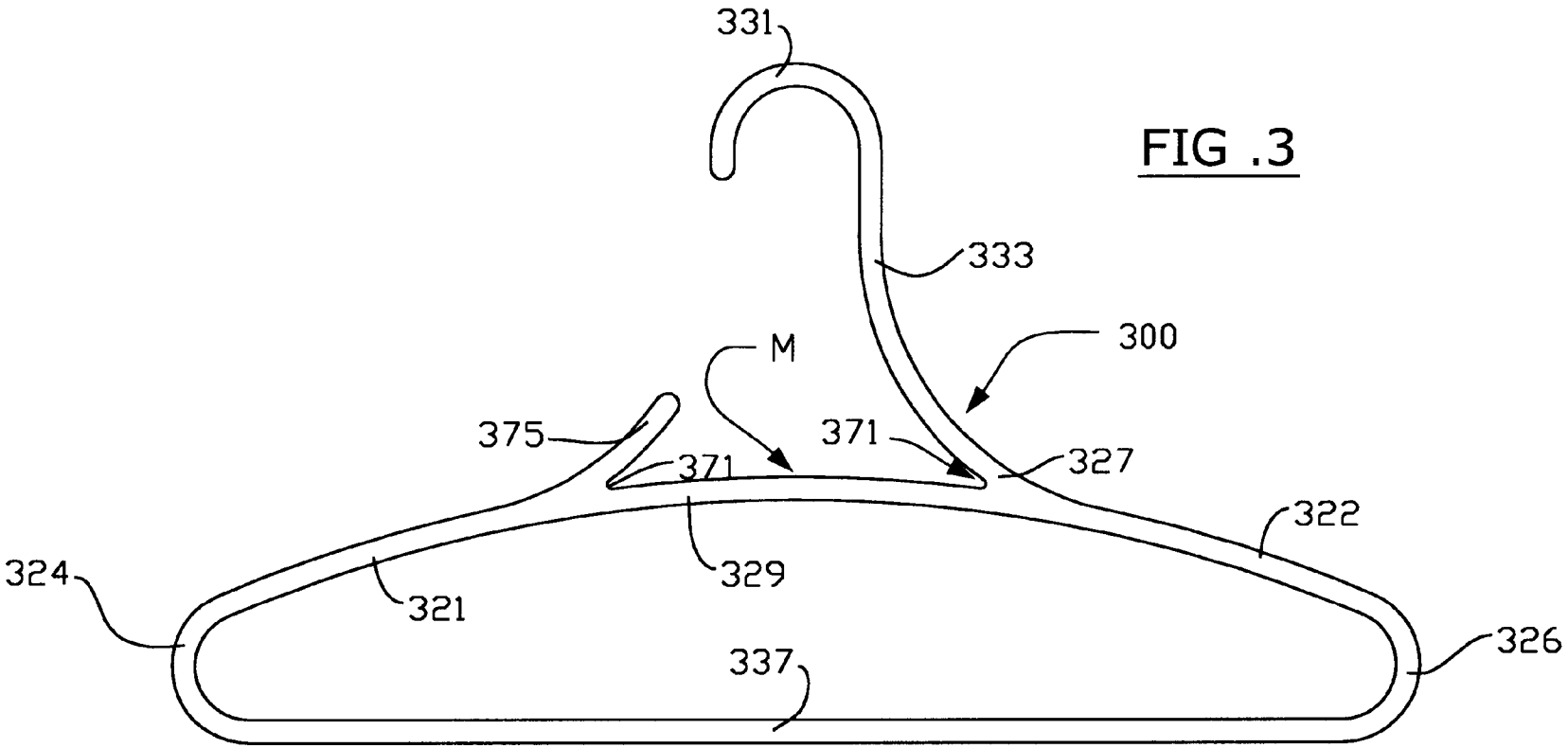
FIG. 3 is a side elevational view of another embodiment of a garment hanger of the instant invention.

Referring now to FIG. 2, there is shown an elevation view of hanger 100 taker from the left end thereof (i.e. end 124) in FIG. 1. It is seen that in the preferred embodiment, the hanger 100, including the combination of the arms 121 and 122, the hook 131, the leg 133, and the cross member 133 have a generally flat or planar configuration although the hanger 100 is, typically, formed of a rod-shaped material Referring now to FIG. 3, there is shown a side elevation of hanger 300 which is another embodiment of this invention. Hanger 300 is quite similar to hanger 100 and incorporates two elongated arms 321 and 322, each of which is adapted for supporting a different opposed shoulder region of a garment as described supra. Arms 321 and 322 are about equal in length and have an outer, rounded, end 324 and 326, respectively. The inner ends thereof meet and join at a mid region 329, respectively. Each arm 321 and 322 extends generally oppositely and downwardly relative to the other and relative to a hanger mid-region 329.

Optionally, but preferably, hanger 300, the outer ends 324 and 326 are interconnected by an elongated lower cross member 337 as described relative to hanger 100

Hanger 300 includes a hook 331 and a smoothly arcuate elongated connecting leg 333, the lower which terminates at, and joins to, arm 322 at a joinder location 327. This configuration is substantially similar to the configuration of hanger 100 shown in FIG. 1. The relationship between the hook 333 and the arms 321 and 323 is such that the hanger 300 is a generally symmetrical, balanced relationship relative to one another and to the mid-region 329.

However, hanger 300 includes a relatively short, generally arcuate stub 375 which extends upwardly from the upper arm 321 thereof. The stub 375 has a generally convex arc and preferably, curves in the opposite direction to the connecting leg 333 of the hook 331. Thus, the stub 375 and the lower end of the connecting leg 333 form complimentary arcuate regions for securing a garment on the hanger 300. The stub 375 is located somewhat short of the mid-point M and about equidistant therefrom relative to the joinder location 327. A support fillet 371 can be utilized, if desired.

Thus, when the arm 321 is inserted into the neck region of a garment in the manner discussed supra, the arm 321 is advanced through the neck region, over the stub 375, past the mid-region M until the neck region is adjacent to the lower portion of leg 333 in the vicinity of joinder location 326. The complementary stub 375 and leg 333 serve to preserve the shape of a garment placed on hanger 300.

Again, preferably, hanger 300 has a flat or planar configuration when viewed in top plan or end elevation.

Figure 4:
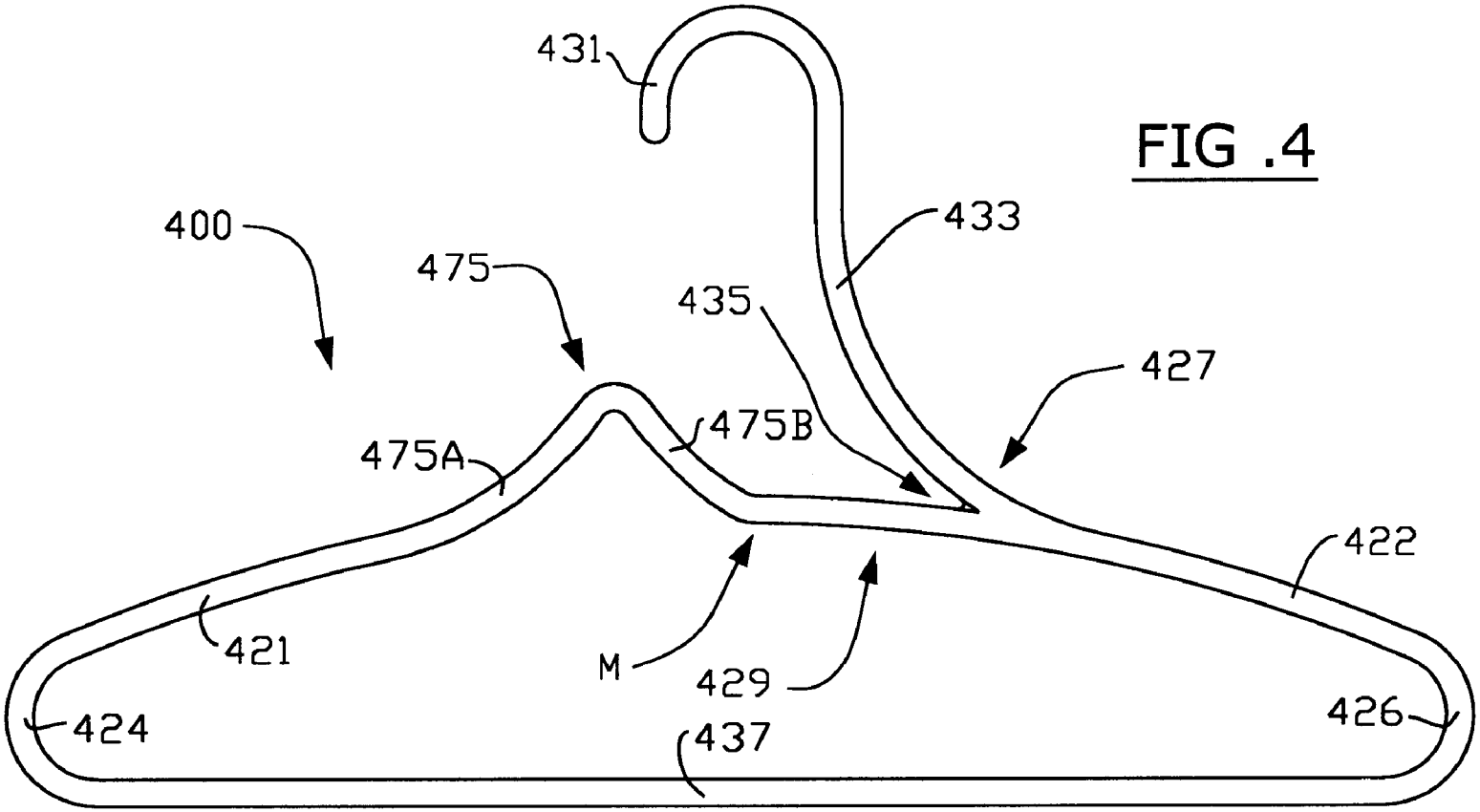
FIG. 4 is a side elevational view of another embodiment of a garment hanger of the instant invention, showing a conventional closet support rod in dotted outline.

Referring now to FIG. 4, there is shown hanger 400 which is another embodiment of a hanger of this invention. Hanger 400 is similar to the hangers 100 and 300 and incorporates two elongated arms 421 and 422, each of which is adapted for supporting a different opposed shoulder region of a garment as described relative to FIGS. 1 and 3. Each arm has rounded outer ends 424 and 426, respectively. The arms 421 and 422 extend, generally, oppositely and downwardly relative to each other and relative to the hanger mid-region 429. Typically, the outer ends 424 and 426 are interconnected together by an elongated lower cross member 437 wherein the interconnections are preferably curved to avoid catching or snagging of a garment or the like.

The hanger 400 includes a hook 431, and a smoothly arcuate, elongated connecting leg 433 the lower end of which terminates at, and joins to, the arm 422. This configuration is substantially similar to the configuration of hanger 100 shown in FIG. 1, whereby the relationship between the hook 431 and the arms 421 and 422 is such that the hanger 400 is generally symmetrical and balanced.

However, hanger 400 includes a knee 475 which extends upwardly from the upper arm 421 thereof. The outer side of knee 475, preferably, curves in the opposite direction to, i.e. is complementary to, the connecting leg 433 of the hook 431. Thus, the outer side 475A of the knee 475 and the lower end of the connecting leg 433 form complimentary arcuate regions for securing a garment on the hanger 400 similar to hanger 300 as described supra.

However, the inner side 475B of the knee 475 is returned to the arm 421 at approximately the mid-point M of the hanger. The knee 475 is located somewhat short of the mid-region 429 and about equidistant therefrom relative to the joinder location. Once again, in the hanger 400, the combination of the arms, the hook 431, the leg 433, the knee 475 and the cross member 437 have a flat or planar configuration when viewed in top plan or end elevation.

Thus, when the arm 421 is inserted into the neck region of a garment in the manner discussed supra, the arm 421 is advanced through the neck region past the knee 475 and mid-region M until the neck region is at least adjacent to the joinder location 427 of lower leg portion 433. The outer side 475A of knee 475 has an arcuate curvature similar to the stub 375 shown in FIG. 3 with the same advantage of garment positioning. In addition, the knee 475 has the further ad vantage of ease of removal of a garment from the hanger 400 because of the smooth inner side 475B of the knee.

Figure 5:
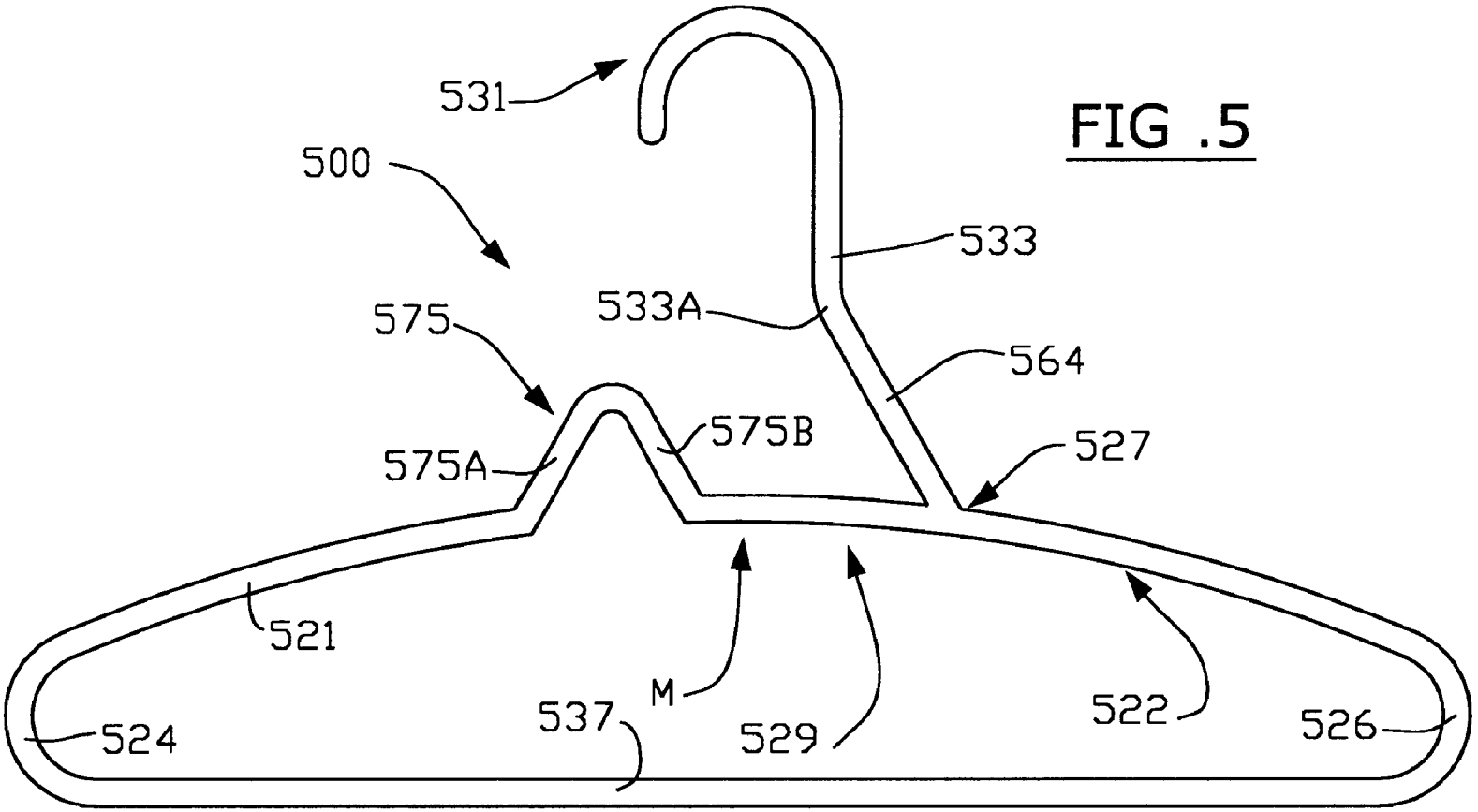
FIG. 5 is a side elevational view of another embodiment of a garment hanger the instant invention.

Referring now to FIG. 5, there is shown a side elevation view of hanger 500 which forms another embodiment of the instant invention. Hanger 500 is similar to hanger 400 described supra and incorporates two elongated arms 521 and 522, each of which is adapted for supporting an opposed shoulder region of a garment. Arms 521 and 522 have outer ends 524 and 526, respectively. Arms 521 and 522 extend generally oppositely and downwardly relative to the other and relative to a hanger mid-region 529. Hanger 500, includes an elongated cross member 537 which is preferred but not required in many cases.

The hanger 500 includes a hook 531. The hook 531 includes an elongated connecting leg 533 which is bent inwardly (i.e. toward the center of the length of the hanger) at an obtuse angle. The lower end 564 of the hanger leg joins the arm 522 at joinder location 527 at an inside acute angle. When hung on a conventional support, hanger 500 assumes a generally symmetrical, balanced relationship. This configuration is somewhat similar to the configuration of hanger 400 shown in FIG. 4.

In addition, hanger 500 includes a generally inverted, V-shaped knee 575 which extends upwardly from upper arm 521. The knee is located somewhat short of the mid-point M and about equidistant therefrom relative to the joinder location 527. The outer leg 575A of the knee typically extends in the opposite direction to the lower leg 564 of the connecting leg 533 of the hook. The inner leg 575B of the knee 575 generally parallels the lower leg 564 of the hook connecting leg 533. Thus, the knee 575 and the lower end 564 of the connecting leg 533 form complimentary regions for securing a garment on the hanger 500. The combination of the arms, the hook, the knee and the cross member have a flat or planar configuration when viewed in top plan or end elevation.

Thus, when the arm 521 is inserted into the neck region of a garment in the manner discussed supra, the arm 521 is advanced through the neck region, past the knee 575 and mid-region 529 until the neck region is at least adjacent to the lower leg portion 564.

Figures 6, 7:
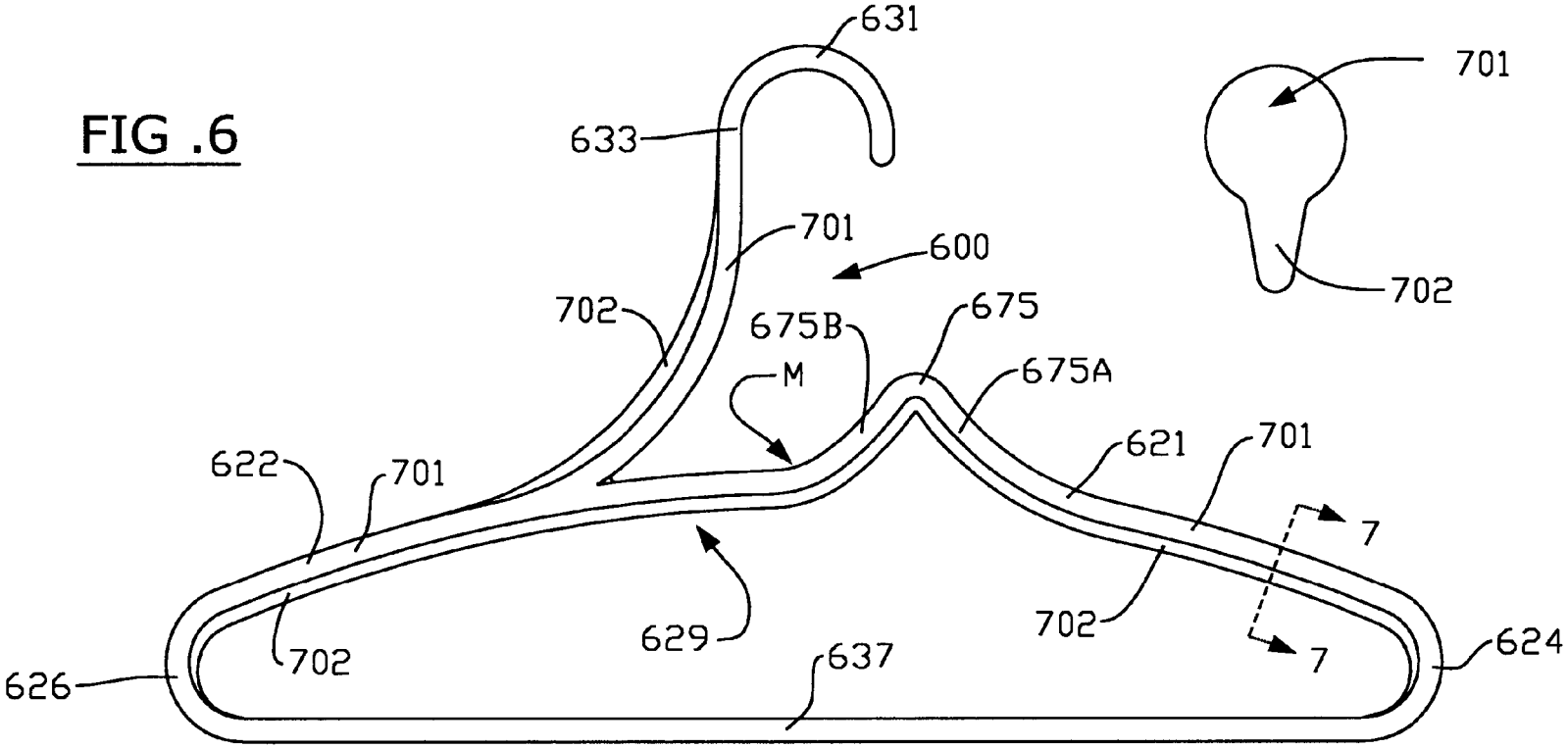
FIG. 6 is a side elevational view of another embodiment of a garment hanger of the instant invention.
FIG. 7 is a cross-sectional view of the hanger embodiment shown in FIG. 6.

Referring now to FIG. 6, there is shown, in side elevation, hanger 600 which is another embodiment of a hanger of this invention. Hanger 600 is similar to the hanger shown in FIG. 4 and incorporates two elongated arms 621 and 622, each of which is adapted for supporting a different opposed shoulder region of a garment as described relative to FIGS. 1 through 5. Each arm has rounded outer ends 624 and 626, respectively. The arms 621 and 622 extend, generally, oppositely and downwardly relative to each other and relative to the hanger mid-region 629. Typically, the outer ends 624 and 626 are interconnected together by an elongated lower cross member 637 wherein the interconnections are preferably curved to avoid catching or snagging of a garment or the like.

The hanger 600 includes a hook 631, and a smoothly arcuate, elongated connecting leg 633 the lower end of which terminates at, and joins to, the arm 622. As noted, this configuration is substantially similar to the configuration of hanger 400 shown in FIG. 4, whereby the relationship between the hook 631 and the arms 621 and 622 is such that the hanger 600 is generally symmetrical and balanced.

Again, hanger 600 includes a knee 675 which extends upwardly from the upper arm 621 thereof. The outer side of knee 675, preferably, curves in the opposite direction to, i.e. is complementary to, the connecting leg 633 of the hook 631. Thus, the outer side 675A of the knee 675 and the lower end of the connecting leg 633 form complimentary arcuate regions for securing a garment on the hanger 600.

Again, in this embodiment, the inner side 675B of the knee 675 is returned to the arm 621 at approximately the mid-point M of the hanger. The knee 675 is located somewhat short of the mid-region 629 and about equidistant therefrom relative to the joinder location. Once again, in the hanger 600, the combination of the arms, the hook 631, the leg 633, the knee 675 and the cross member 637 have a flat or planar configuration when viewed in top plan or end elevation. However, in this embodiment, the hanger 500 includes a support structure for providing additional strength thereto.

Referring concurrently to FIG. 7, there is shown a cross-sectional view of the structure of hanger 600 taken along the line 7—7 in FIG. 6. Thus, as seen in FIGS. 6 and 7, the structure of hanger 600 includes a generally cylindrical body 701 which is fairly conventional in plastic hanger construction.

In addition, the structure of hanger 600 includes a tapered, generally triangular shaped support portion 702 formed integrally with the cylinder 701. The support portion or tail 702 can be on the bottom of the rod, as seen in arms 621 and 622 in FIG. 6. Alternatively, the support tail 702 can be on the top of the rod as seen in leg 633 in FIG. 6. The tail 702 is not required in all hangers but provides a unique structural strength as desired and may be utilized with any of the hanger embodiments described supra.

Thus, the structurally enhanced hanger 600 can be inserted into the neck region of a garment in the manner discussed supra relative to the other embodiments of the invention.

Each of the hanger embodiments described supra can be constructed of various conventional materials using various conventional construction methods. For example, the hanger can be comprised of molded or preformed plastic with a tubular or rod cross section with or without the support tail. Alternatively, a hanger can be comprised of a preformed metal wire which can be twisted, welded or the like at the joinder location. If so desired, the hanger can then be plated, anodized, painted, coated with an elastomeric plastic, or the like.

Hangers can be variously otherwise formed using, for example, preformed plastic rodding, plastic extrusions, plastic coated wire, plastic tubing, metal tubing, mixtures thereof or the like, as desired by a fabricator. Various conventional working and forming procedures can be used to fabricate a single hanger, such as compression or laser cutting and/or heat forming.

If desired "frictionizers" or non-slip strips can be added to hanger surfaces so as to provide a non-slipping or slip retarding feature to deter a garment from slipping off a hanger.

Thus, there is shown and described a unique design and concept of a garment hanger. While this description is directed to several embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A garment hanger comprising, first and second elongated arms arranged for supporting the opposed shoulders of a garment, each of said first and second arms having an outer end and an inner end, said outer ends spaced apart relative to one another, said inner ends joined together to form a continuous mid-region therebetween, and a suspending device for hanging said hanger so that said first and second arms are in a generally symmetrical, balanced relationship relative to one another and to said mid-region section, said suspending device includes a hook member, said suspending device having an elongated connecting leg the upper end of which is joined to said hook member and the lower and of which terminates at a junction with one of said first and second elongated arms adjacent to said mid-region section, said elongated connecting leg having a mid-portion thereof intermediate said upper and lower ends, said mid-portion of said elongated connecting leg defines an arcuate configuration which is bent inwardly between said outer ends toward said mid-region section, said lower end of said elongated connecting leg having an orientation which defines an acute inner angle with an extension of at least one of said first and second elongated arms and said mid-region section.

2. The hanger recited in claim 1 wherein, said said arcuate configuration of said mid-portion of said elongated connecting leg defines an obtuse angle configuration.

3. The hanger recited in claim 1 including, an extension of a second of said first and second arms which extends above the second arm at a complimentary angle relative to said lower end of said elongated connecting leg.

4. The hanger recited in claim 3 including, a return component between said extension and said mid-region section.

5. A garment hanger comprising, first and second elongated arms arranged for supporting the opposed shoulders of a garment, each of said first and second arms having an outer end and an inner end, said outer ends spaced apart relative to one another, said inner ends joined together to form a continuous mid-region therebetween, a suspending device for hanging said hanger so that said first and second arms are in a generally symmetrical, balanced relationship relative to one another and to said mid-region section, said suspending device includes a hook member, said suspending device having an elongated connecting leg the upper end of which is joined to said hook member and the lower end of which terminates at a junction with one of said first and second elongated arms adjacent to said mid-region section, said elongated connecting leg having a mid-portion thereof intermediate said upper and lower ends which extends inwardly between said outer ends toward said mid-region section, said lower end of said elongated connecting leg having an orientation which defines an acute inner angle with an extension of at least one of said first and second elongated arms and said mid-region section, and a support member formed on at least one of said first and second elongated arms and said elongated connecting leg to provide enhanced strength thereto, said support member comprises a tapered fillet integrally formed with the respective hanger component.

6. The hanger recited in claim 1 including, a third elongated arm spaced apart from said first and second elongated arms and interconnected between the outer ends thereof.

7. The hanger recited in claim 1 wherein, said hanger is fabricated of molded plastic.

* * * * *